US006414538B1

(12) United States Patent
Bosnyak et al.

(10) Patent No.: US 6,414,538 B1
(45) Date of Patent: Jul. 2, 2002

(54) CIRCUIT TO REDUCE AC COMPONENT OF BIAS CURRENTS IN HIGH SPEED TRANSISTOR LOGIC CIRCUITS

(75) Inventors: Robert J. Bosnyak, San Jose; Jose M. Cruz, Palo Alto, both of CA (US)

(73) Assignee: Sun Microsystems, Inc., Palo Alto, CA (US)

( * ) Notice: Subject to any disclaimer, the term of this patent is extended or adjusted under 35 U.S.C. 154(b) by 0 days.

(21) Appl. No.: 09/680,673

(22) Filed: Oct. 6, 2000

(51) Int. Cl.[7] ..... G05F 3/02
(52) U.S. Cl. ..... 327/540; 327/552
(58) Field of Search ..... 327/538–543, 327/551–554

(56) References Cited

U.S. PATENT DOCUMENTS 5,059,838 A * 10/1991 Motegi et al. ..... 327/534
5,486,787 A * 1/1996 Maekawa et al. ..... 327/541

* cited by examiner

*Primary Examiner*—Kenneth B. Wells
(74) *Attorney, Agent, or Firm*—Townsend and Townsend and Crew, LLP

(57) ABSTRACT

A low-pass filter to filter the internal bias voltages. It is connected locally at the bias voltage input of each bias current source the low-pass filter reduces the AC overshoot oscillations of a local bias voltage generated by the bias voltage generator upon a changing in the amount of current sourced by other current sources. A single bias voltage generator is connected to a bias voltage input of a number of bias current sources. Each current source has a low pass filter to filter the bias voltage.

5 Claims, 6 Drawing Sheets

CIRCUIT TO REDUCE AC COMPONENT OF BIAS CURRENTS IN HIGH SPEED TRANSISTOR LOGIC CIRCUITS

BACKGROUND OF THE INVENTION

The present invention relates generally to integrated circuit design, and, particularly to a bias circuit to provide stable bias currents in high speed transistor logic.

Sun Microsystems, Inc. has developed output driver logic for single ended high speed drivers called SHSTL or Sun High Speed Transistor Logic. This family generally requires that VOH (output high voltage) and VOL (output low level) be 1.5 volts and 0.75 volts, respectively. In addition, the characteristic impedance of the output driver is specified to be 50 ohms. The receiver network is limited to be 50 ohms terminated to 1.5 volts. Rise and fall times are specified to be in the region of 200 to 300 pico seconds achieved by switching current sources and current sinks at the output node that can drive up to 16 mA. The output driver is designed in an IC technology to be used in a package with significant bondwire inductance for the frequencies of SHSTL (from 1.6 nH to 6 nH in each external pin). The inductance of the bondwires has less effect in most prior art circuits because slower speeds are used. SHSTL uses lower voltage swings to achieve extremely high switching speeds. At these high speeds, the bondwire inductance becomes a significant factor.

A high speed transistor logic circuit, such as a SHSTL circuit, typically has fast rise and fall output times, has significant bondwire inductances, and has parasitic capacitances.

FIG. 1 depicts a macromodel of an output of high speed transistor logic circuit 100. Current source 130 and parasitic capacitance 135 represent an output driver for sourcing current to an output line 112. Current source 140 and parasitic capacitance 145 represent an output driver for sinking current from line 112. Line 112 is one of many output lines on an integrated circuit. Circuit 100 includes other circuits 110, a first bondwire having an inductance 120, a second bondwire having an inductance 125, a first current source 130, a first parasitic capacitance 135, a second current source 140, and second parasitic capacitance 145. Other circuits 110 represent the rest of the chip. They are coupled to a first supply voltage, VDD, via a first bondwire having an inductance 120 and are coupled to a second supply voltage, a ground supply voltage, GND, via a second bondwire having an inductance 125. As a result of the inductance of the bondwire, the actual voltages presented to the internal circuits of circuit 100 are internal VDD and GND, different than VDD and GND. v1 represents VDD after passing through inductance 120, and v2 represents the ground level above inductance 125. A first voltage signal, v1 and a second voltage signal, v2, are presented to other circuits 110, v1 is presented to first current source 130, and v2 is presented to second current source 140. First current source 130 outputs a first current signal, il. Second current source 140 outputs a second current signal, i2. An input terminal of high speed transistor logic circuit 100 is coupled to the other circuits 110, and an output of high speed transistor logic circuit 100 is coupled to first current source 130 and second current source 140.

FIGS. 2A–2D depict some of the problems encountered by a high speed transistor logic circuit, such as circuit 100, with fast rise and fall output times, with significant bondwire inductances, and with parasitic capacitances.

The problem is that when the single ended output in circuit 100 is rising, or falling, the total current, i1 and i2, through the power lines change significantly (in the order of tens of mA) in a very short amount of time (in the order of hundreds of picoseconds), as depicted in FIGS. 2A and 2B. For example, a 10 mA peak 115 of i1 is shown, as well as a 8 mA peak 118 of i2, from a steady state level of 2 mA.

The rapid change of current through the inductive bondwires with bondwire inductances 120 and 125 causes in turn a change of the internal voltage supplies (internal VDD and internal GND), with voltage signals v1 and v2 respectively, as depicted in FIGS. 2C and 2D. Peak 115 in i1 causes a peak 116 in v1, while peak 118 in i2 causes a peak 119 in v2. Peak 116 decays through a series of oscillations 117 about VDD. The ground spike similarly tails off in oscillations. As can be seen, different peaks occurring at different times on different pins cause a succession of noise spikes affecting the voltage bias. The combination of the bondwire inductances 120 and 125 with other elements in the chip, particularly parasitic capacitances 135 and 145, create damped oscillations in the internal supply references after each output transition. These oscillations have initial amplitudes in the order of 50 mV and frequency in the order of 1–2 GHz, and they typically do not damp significantly in the time interval between two output transitions (about 1.6 ns). The oscillations in the internal VDD and GND are not synchronized since the current flow is different in VDD and GND (the difference flows by the output pin and other pins) and each one of these two nodes have different bondwire inductance and capacitance elements (bondwire inductance 120 and parasitic capacitance 135 for VDD and bondwire inductance 125 and parasitic capacitance 145 for GND) connected to them.

These oscillations of the voltages at the internal VDD and GND nodes mean that all nodes between the two supplies have some AC component variation as well. This in turn also makes it difficult to create stable bias current circuits. Specifically, these oscillations in the internal power supply voltage references can create a significant AC component in the currents delivered by some internal bias current sources in bias circuits within a typical high speed transistor logic circuit 100.

FIG. 3A depicts a typical bias circuit 310 inside a typical high speed transistor logic circuit 100. Bias circuit 310 includes a bias voltage generator 320, a first bondwire inductance 330, a second bondwire inductance 334, and third bondwire inductance 338, and a bias current source 340. Bias voltage generator 320 is coupled to a first supply voltage, VDD, via first bondwire inductance 330 and is coupled to ground via second bondwire inductance 334 (designated GND1 to distinguish from ground through other pins). The bias voltage generator outputs a bias voltage, vbias, at a bias voltage output. A first voltage signal, v1, is presented to bias voltage generator 320.

Bias current source 340 is coupled to ground, GND2 (the same ground as GND1, but through a different pin), via a third bondwire with inductance 338. The bias current source is coupled to the bias voltage output and receives as an input vbias. A second voltage signal, v2, is the effective ground presented to bias current source 340.

FIG. 3B depicts the bias current, illustrating some of the problems encountered by bias circuit 310 within high speed transistor logic circuit 100. The oscillations in the internal power supply voltage references, as depicted in FIGS. 2C and 2D, can create a significant AC component in the current, $i_{bias}$, delivered by internal bias current source 340 in bias circuit 100.

Consequently, the significant AC component in the current, $i_{bias}$, delivered by internal bias current source 340, can have a detrimental effect in the performance of high speed logic circuit 100, such as the reduction in the accuracy of the output levels of high speed logic circuit 100. Also, the significant AC component can reduce the predictability of the delay times between an input transition and an output transition for high speed logic circuit 100.

FIG. 4 depicts a known circuit 400 for attempting to attenuate the oscillations in the VDD and GND high speed transistor logic circuit 100. In the past, a typical solution to this problem involved shunting local VDD and GND with by-pass capacitors 420 and 430, to stabilize the supplies. However, at the high frequencies used by SHSTL, this shunting runs the risk of creating a resonation path between the by-pass capacitors and the bondwire inductances.

For the foregoing reasons, a bias circuit to provide stable bias currents in a high speed transistor logic circuit having fast rise and fall output times, significant bondwire inductances, and parasitic capacitances is needed which does not create resonation paths with the bondwire inductances.

SUMMARY OF THE INVENTION

The present invention provides a low-pass filter to filter the internal bias voltages. It is connected locally at the bias voltage input of each bias current source so each individual current source is not coupled to its neighbors the low-pass filter reduces the AC overshoot oscillations of a local bias voltage generated by the bias voltage generator upon a changing in the amount of current sourced by other current sources. A single bias voltage generator is connected to a bias voltage input of a number of bias current sources. Each current source has a low pass filter to filter the bias voltage.

In a specific embodiment, the low-pass filter includes: a resistor having a first terminal coupled to the filter input and a second terminal coupled to the first filter output; and a capacitor with a first terminal coupled to the second terminal of the resistor and with a second terminal coupled to the second filter output, where the value of the resistance of the resistor and the value of the capacitance of the capacitor are chosen so as to produce an RC time constant whose inverse is much less than frequency of oscillation of the internal ground.

DESCRIPTION OF THE SPECIFIC EMBODIMENTS

In the description that follows, the present invention is explained in reference to a preferred embodiment. The description of the preferred embodiment that follows is intended to be illustrative, but not limiting, of the scope of the present invention as set forth in the claims.

The present invention relates to a bias circuit to provide stable bias currents in a high speed transistor logic circuit having fast rise and fall output times, significant bondwire inductances, and parasitic capacitances without creating resonation paths with the bondwire inductances.

Figure 5:
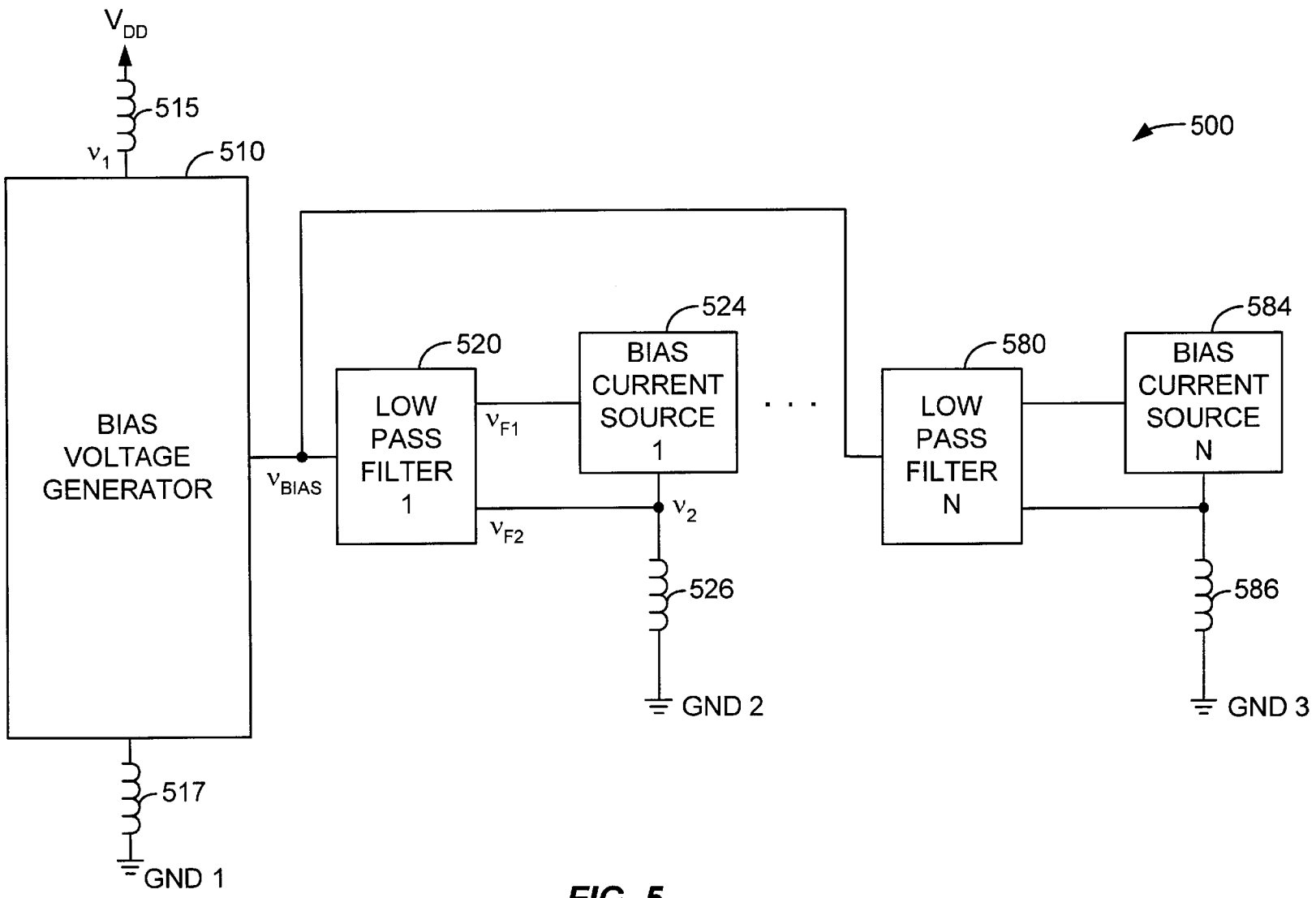
FIG. 5 depicts a bias circuit to provide stable bias currents in high speed transistor logic.

FIG. 5 depicts a bias circuit 500 to provide stable bias currents in high speed transistor logic. Bias circuit 500 includes a bias voltage generator 510 connected to VDD with a first bondwire having an inductance 515, and connected to ground with a second bondwire having an inductance 517. The bias voltage generator provides a bias voltage to N bias current sources on the chip. Only bias current sources 1 and N are shown. A first low pass filter 520 connects to a first bias current source 524. A bondwire inductance 526 is present between bias current source 524 and the ground it connects to, designated GND2. Also shown is an Nth low pass filter 580, a Nth bias current source 584, and a Nth bondwire inductance 586, connected to another ground pin GND3. Bias voltage generator 510 is coupled to a first supply voltage, VDD, via first bondwire inductance 515 and is coupled to a second supply voltage, a first ground supply voltage, GND1, via second bondwire inductance 517. The bias voltage generator outputs a bias voltage, vbias, at a bias voltage output. A first voltage signal, v1, is the internal VDD presented to bias voltage generator 510.

Each low pass filter 520, 580, has a filter input coupled to the bias voltage output and receives as an input $v_{bias}$. Each low pass filter 520, 580 has a first filter output and a second filter output coupled to ground via a bondwire inductance, 526, 586, respectively.

Each bias current source 524, 584 has a control input coupled to the first filter output of low pass filter 520, 580 respectively, and a ground connection via bondwire inductances 526, 586, respectively.

Each low-pass filter 520, 580 reduces the AC overshoot oscillations of bias voltage vbias generated by bias voltage generator 510 at the bias voltage output upon a changing in the amount of current sourced by other current sources, such as 130 and 140. This results in the voltage reference, $v_{bias}$, (having AC noise) being broadcast to each current source where the AC noise is locally attenuated by the respective low pass filter of that current source. A similar filter arrangement may be used for the bias current sources connected to VDD.

Figure 1:
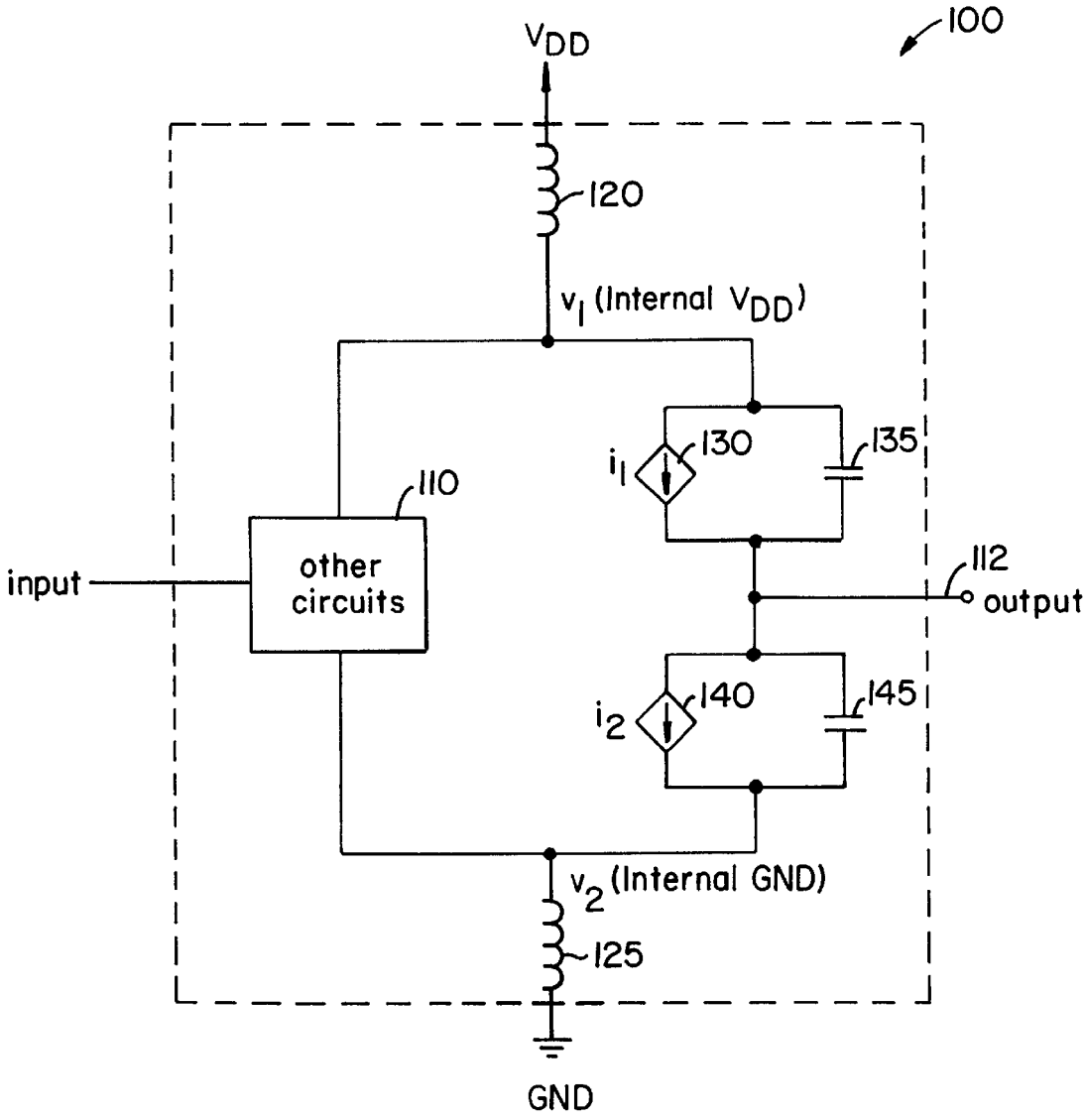
FIG. 1. PRIOR ART
FIG. 1 depicts a macromodel of a high speed transistor logic circuit.
Figure 2A:
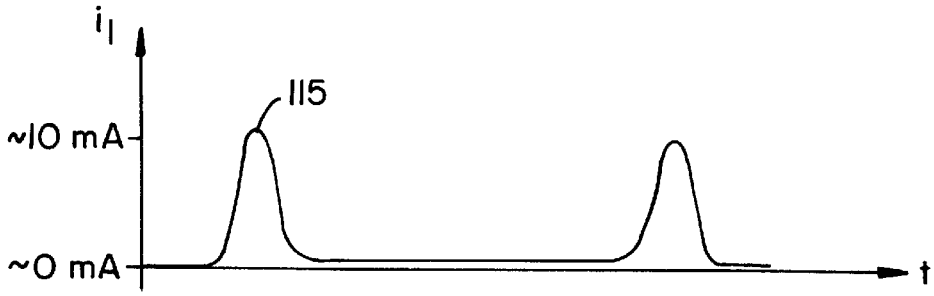
FIGS. 2A–2D are current and voltage timing diagrams depicting some of the problems encountered by a high speed transistor logic circuit with fast rise and fall output times, with significant bondwire inductances, and with parasitic capacitances.
Figure 2B:
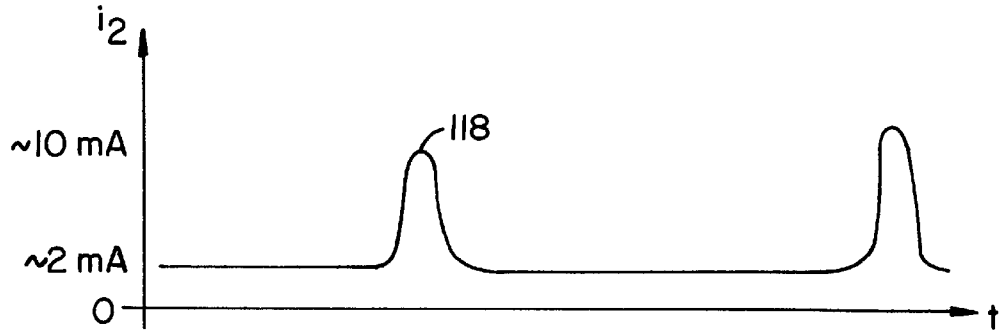
Figure 2C:
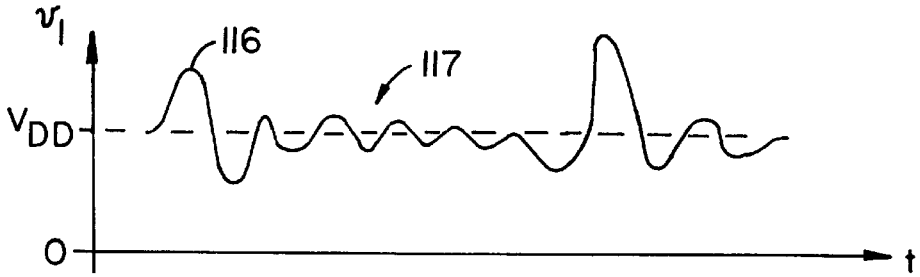
Figure 2D:
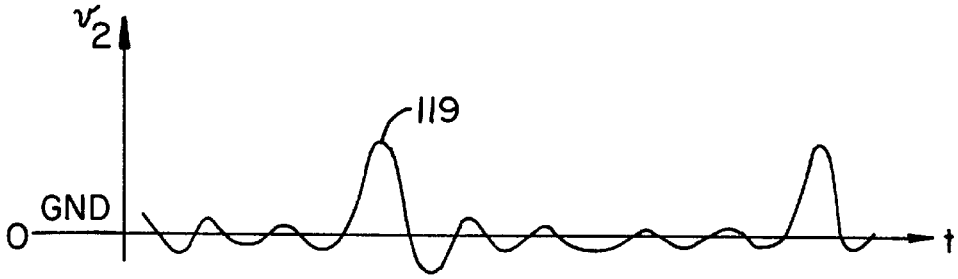
Figure 3A:
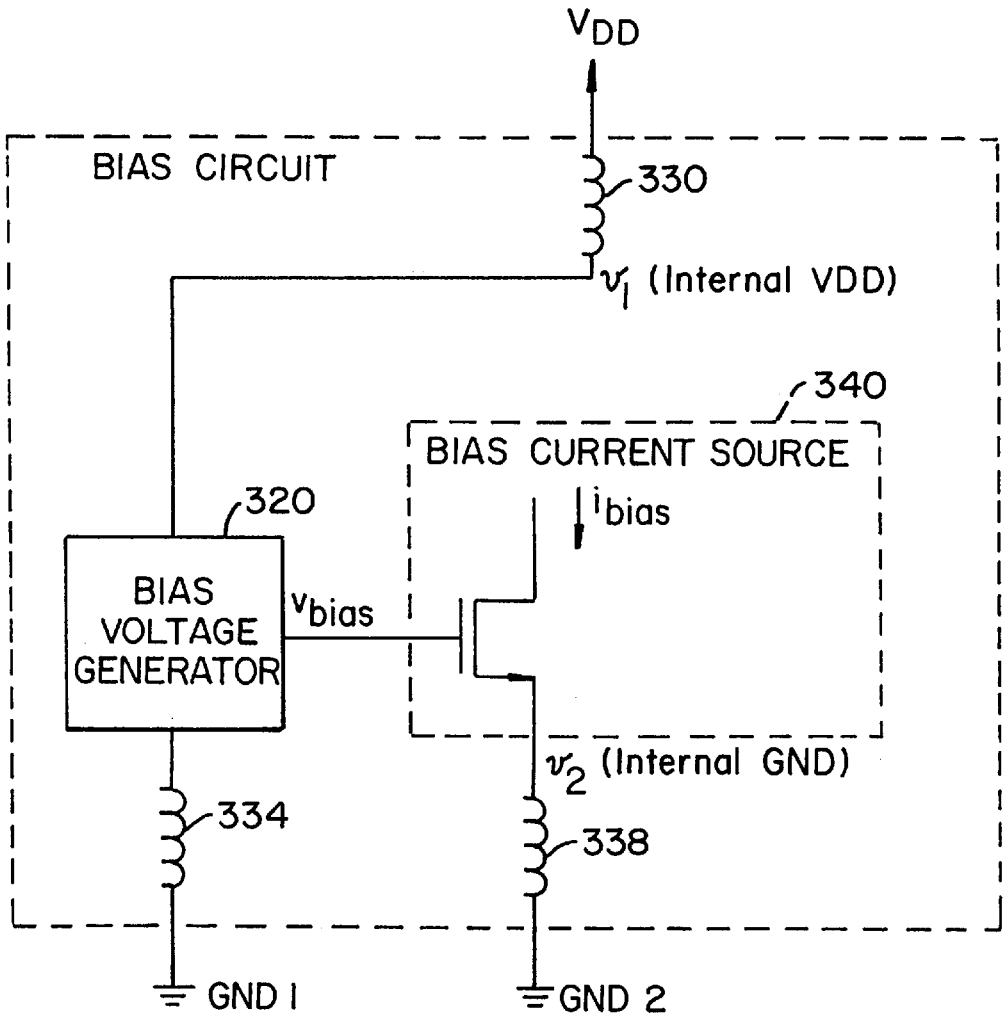
FIG. 3A. PRIOR ART
FIG. 3A depicts a typical prior art bias circuit inside a typical high speed transistor logic circuit.
Figure 3B:
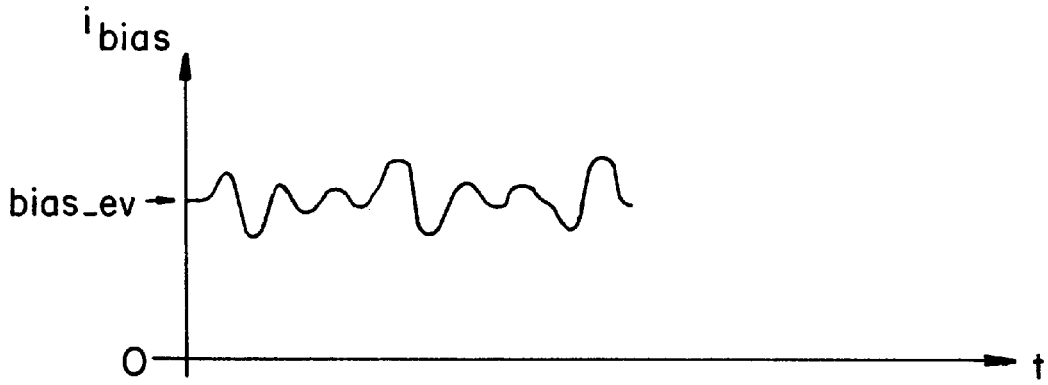
FIG. 3B is a bias voltage timing diagram depicting some of the problems encountered by the bias circuit within the high speed transistor logic circuit.
Figure 6:
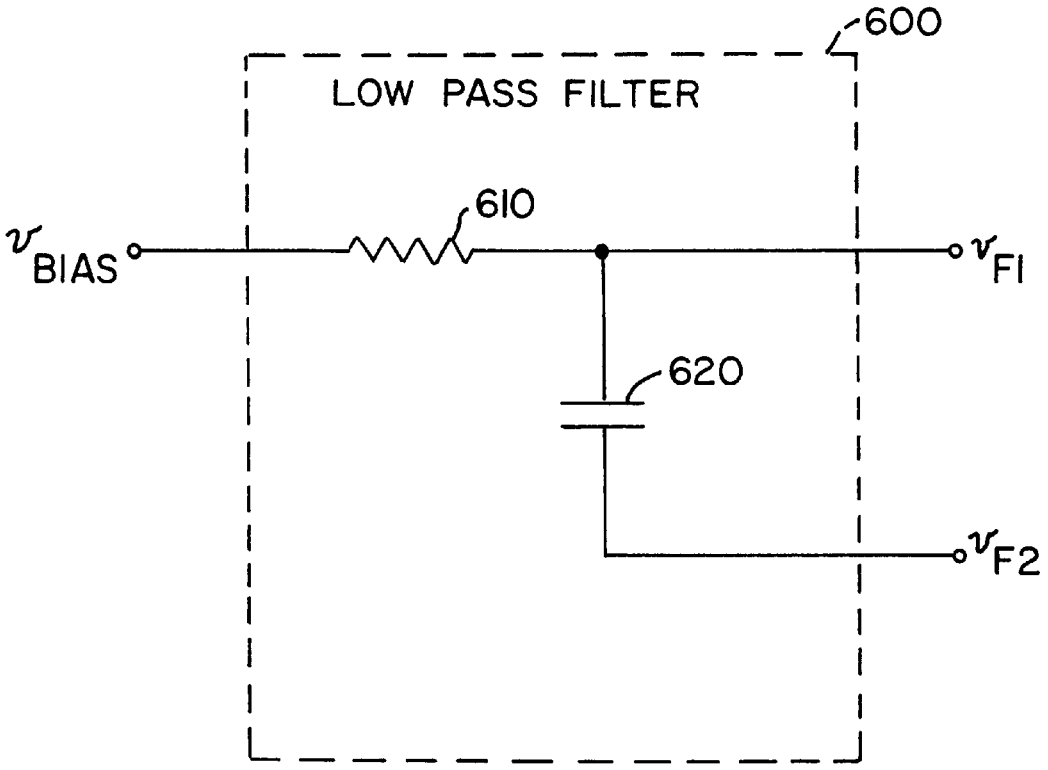
FIG. 6 is a circuit diagram of the low pass filter of FIG. 5.
Figure 4:
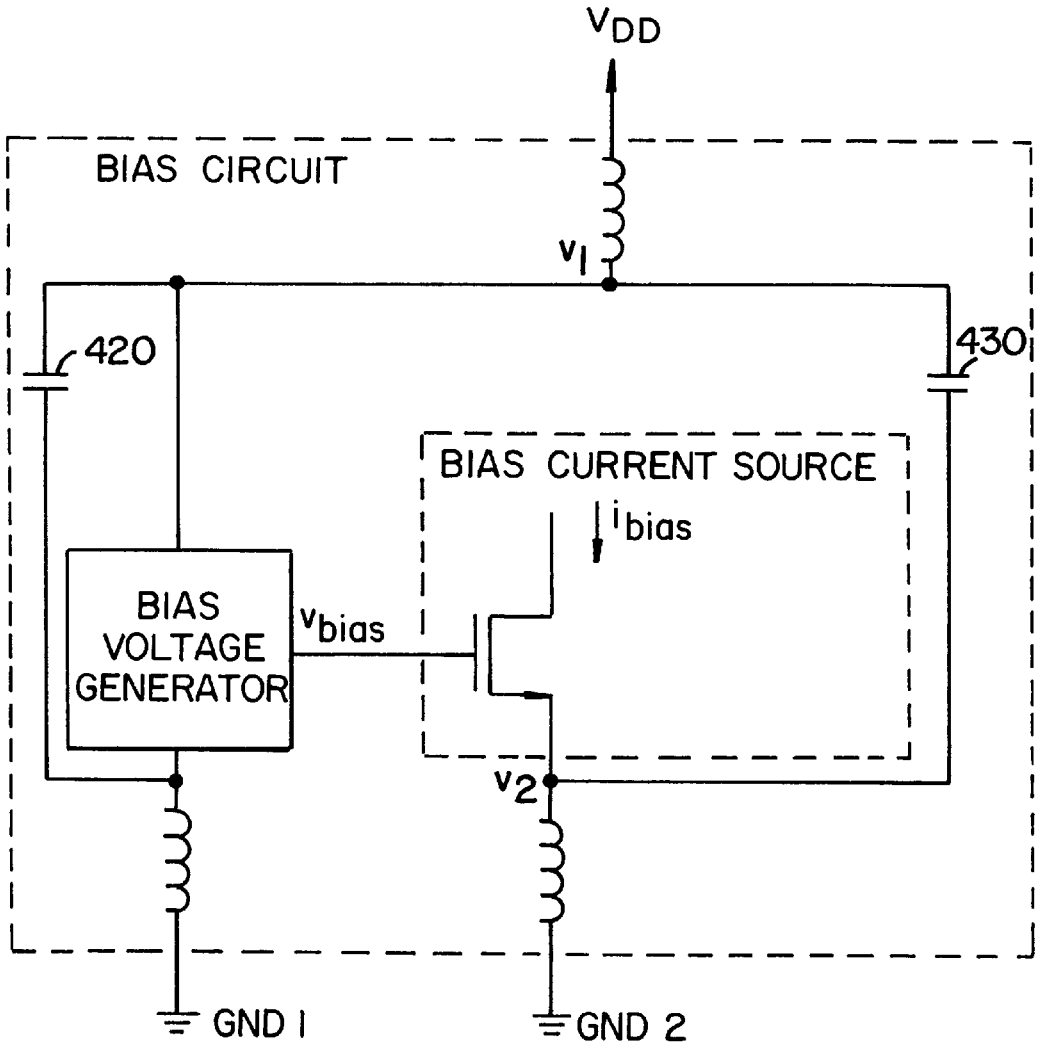
FIG. 4. PRIOR ART
FIG. 4 depicts a known circuit 400 for attempting to attenuate the oscillations in the VDD and GND high speed transistor logic circuit.

FIG. 6 depicts a low pass filter 600 to be used with the bias circuit 500. In a specific embodiment, the low-pass filter includes: a resistor 610 having a first terminal coupled to the filter input and a second terminal coupled to the first filter output and a capacitor 620 with a first terminal coupled to the second terminal of the resistor and with a second terminal coupled to the second filter output, where the value of the resistance of resistor 610 and the value of the capacitance of capacitor 620 are chosen so as to produce an RC time constant whose inverse is much less than frequency of oscillation of the supply voltage or ground. Consequently, this filter attenuates the local AC oscillations due to the bouncing of the internal supplies while avoiding the creation of an LC loop between the bondwire inductances and the new capacitor.

The availability of these more stable bias currents make the rise and fall times of the high speed transistor logic (HSTL) circuit 100 more stable. This in turn reduces jitter between transitions, thus enabling the HSTL circuit to be used at shorter time intervals between transitions.

The invention has been explained with reference to a specific embodiment. Other embodiments will be apparent to those of ordinary skill in the art. It is therefore not intended that this invention be limited, except as indicated by the appended claims.

What is claimed is:

1. A bias circuit integrated in a semiconductor chip and packaged in a semiconductor chip package, said bias circuit configured to provide stable bias currents in high speed transistor logic, wherein said bias circuit comprises:

a bias voltage generator having a first supply input coupled to a first supply pin of the chip package, a bias voltage output, and a second supply input coupled to a second supply pin of the chip package;

a low-pass filter having a filter input coupled to said bias voltage output, a first filter output, and a second filter output coupled to a third supply pin of the chip package; and a current source having a control input coupled to said first filter output, and a power supply input coupled to said third supply pin, wherein said low-pass filter is configured to reduce AC overshoot oscillations of a bias voltage generated by said bias voltage generator at said bias voltage output.

2. The circuit of claim 1 wherein said low-pass filter comprises:

a resistor having a first terminal coupled to said filter input and a second terminal coupled to said first filter output; and a capacitor having a first terminal coupled to said second terminal of said resistor and a second terminal coupled to said second filter output, wherein the value of a resistance of said resistor and the value of a capacitance of said capacitor are chosen, so as to produce an RC time constant having an inverse that is less than the natural frequency of oscillation of a voltage of the power supply or ground.

3. The circuit of claim 1 further comprising:

a plurality of additional low-pass filters coupled to said bias voltage generator; and a plurality of additional current sources, wherein each of said plurality of said additional current sources is coupled to a different one of said plurality of said additional low-pass filters.

4. The bias circuit of claim 1 wherein the first supply pin is coupled to a power supply and the second and third supply pins are coupled to ground.

5. A method for operating a bias circuit, which is integrated in a semiconductor chip and packaged in a semiconductor chip package, to provide stable bias currents in high speed transistor logic, comprising:

generating a bias voltage output with a bias voltage generator having a first supply input coupled to a first supply pin of the chip package and a second supply input coupled to a second supply pin of the chip package;

filtering said bias voltage output with a low-pass filter having a filter input coupled to said bias voltage output, a first filter output, and a second filter output coupled to a third supply pin of the chip package; and providing said filtered bias voltage as a bias input to a current source having a control input coupled to said first filter output, and a power supply input coupled to said third supply pin.

* * * * *